US006282754B1

(12) United States Patent
Leder

(10) Patent No.: US 6,282,754 B1
(45) Date of Patent: Sep. 4, 2001

(54) MEANS FOR EQUALIZING HEAT EXPANSION IN A CARDING MACHINE

(75) Inventor: Armin Leder, Mönchengladbach (DE)

(73) Assignee: Trüztschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/711,085

(22) Filed: Nov. 14, 2000

Related U.S. Application Data

(63) Continuation of application No. 09/585,544, filed on Jun. 2, 2000, now abandoned.

(30) Foreign Application Priority Data

Jun. 2, 1999 (DE) ..... 199 25 285

(51) Int. Cl.[7] ..... D01G 15/40
(52) U.S. Cl. ..... 19/98; 19/105
(58) Field of Search ..... 19/98, 99, 102, 19/103, 104, 105, 111, 113, 114

(56) References Cited

U.S. PATENT DOCUMENTS

| | | | | |
|---|---|---|---|---|
| 4,499,632 | | 2/1985 | Varga . | |
| 5,040,272 | * | 8/1991 | Fritzsche | 19/104 |
| 5,127,134 | * | 7/1992 | Demuth et al. | 19/102 |
| 5,186,473 | * | 2/1993 | Windges et al. | 19/98 |
| 5,271,125 | * | 12/1993 | Leifeld et al. | 19/103 |
| 5,398,381 | * | 3/1995 | Schlichter et al. | 19/102 |
| 5,918,349 | * | 7/1999 | Leifeld et al. | 19/103 |
| 5,920,961 | * | 7/1999 | Hollingsworth | 19/98 |
| 6,189,184 | * | 2/2001 | Pferdmenges et al. | 19/104 |

FOREIGN PATENT DOCUMENTS

| | | |
|---|---|---|
| 40 34 841 | 5/1992 | (DE) . |
| 42 35 620 | 4/1994 | (DE) . |
| 0 431 485 | 6/1991 | (EP) . |

* cited by examiner

*Primary Examiner*—John J. Calvert
*Assistant Examiner*—Gary L. Welch
(74) *Attorney, Agent, or Firm*—Venable; Gabor J. Kelemen

(57) ABSTRACT

A carding machine includes a main carding cylinder including a cylindrical jacket having an outer surface; a cylinder clothing carried on the outer jacket surface; and radial supporting elements supporting the cylindrical jacket. The carding machine further has a machine element defining a radial clearance with the cylinder clothing; two stationary lateral shield plates flanking the main carding cylinder; and an arrangement for reducing heat removal from the lateral shield plates to adapt a heat-caused expansion of the lateral shield plates to a heat-caused expansion of the main carding cylinder.

6 Claims, 3 Drawing Sheets

MEANS FOR EQUALIZING HEAT EXPANSION IN A CARDING MACHINE

CROSS REFERENCE TO RELATED APPLICATION

This application is a continuation of application Ser. No. 09/585,544 filed Jun. 2, 2000 now abandoned.

This application claims the priority of German Application No. 199 25 285.8 filed Jun. 2, 1999, which is incorporated herein by reference.

BACKGROUND OF THE INVENTION

This invention relates to a carding machine which includes a main carding cylinder having a clothed cylindrical jacket and at least two radial carrier elements. The carding machine further includes at least one clothed and/or non-clothed machine element facing the carding cylinder and two stationary lateral shield plates which support holding devices for the working element, for example, bends, stationary carding elements or cylinder covers.

The effective distance of the clothing points of the carding cylinder clothing from a machine element facing the clothing is defined as the carding gap or carding clearance. Such a machine element may also have a clothing but may be, for example, a shell segment having a smooth guiding surface. The size (width) of the carding gap is a significant machine parameter which affects both the fiber processing and the operating behavior of the machine. The carding gap is set to be as narrow as possible (it is measured in the tenths of millimeters) without, however, risking a collision between the working elements. To ensure a uniform processing of the fibers, the gap should be as uniform as possible over the entire working width of the carding machine.

The carding gap is affected particularly by the machine settings, on the one hand, and the condition of the clothing, on the other hand. The most important carding gap of a traveling flats-type carding machine is in the principal carding zone, that is, between the main carding cylinder and the traveling flats assembly.

In order to increase the output of the carding machine, it has been attempted to select the operational rpm or the operational velocity as high as permitted by the fiber processing technology. The working distance (carding gap) changes as a function of the operating conditions; the change occurs in the radial direction (as related to the rotary axis) of the carding cylinder.

In current carding processes the rate of processed fibers is continuously increased which requires increasingly higher velocities of the working organs and increasingly higher outputs of the individual, installed units of the carding machine. An increasing fiber output rate (production) leads, even if the working surfaces remain constant, to greater heat generation because of the increased mechanical work. At the same time, however, the technological carding result (sliver uniformity, degree of cleaning, reduction of neps, etc.) is continuously improved which requires a greater number of carding surfaces and narrower settings of the carding gaps of the working surfaces with respect to the main carding cylinder. Further, the proportion of chemical fibers to be processed steadily increases. During the carding process chemical fibers, because of greater friction, generate more heat than cotton as they contact the working faces of the carding machine. The working components of high-performance carding machines are in current designs fully encapsulated from all sides to comply with high safety requirements, to prevent particle emission into the blow room and to minimize machine maintenance. Grates or exposed material guiding surfaces which provided for an air exchange, belong to the past.

Due to the above-discussed circumstances, the heat input to the carding machine has significantly increased while the heat removal by convection has substantially dropped. The resulting stronger heat-up of high performance carding machines leads to greater thermoelastic deformations which, because of the non-uniform distribution of the temperature field, affect the set distances between the working surfaces. Thus, the distance between carding cylinder and traveling flats, doffer and stationary flats as well as separating locations decreases. In extreme cases heat expansion may even cause the set gap between the working surfaces to disappear entirely, and thus relatively moving machine components may collide, resulting in significant damages to the high performance carding machine. Furthermore, particularly the production of heat in the working region of the carding machine may lead to different thermal expansions if an excessive temperature difference between the structural components exists.

In a known device, as disclosed in European patent document 0 431 485, to which corresponds U.S. Pat. No. 5,127,134, a channel is provided through which a medium flows in order to remove heat from the flat bars or from a clothed or non-clothed shell component covering the cylinder. As a result of such an arrangement, in case of a heat expansion of the carding cylinder, the carding gap is disadvantageously even further reduced.

Further, a liquid transport system within the carding cylinder has been proposed to compensate for the temperature conditions at the external circumference of the carding cylinder. During operation an access to such a liquid transport system may occur only through the cylinder axis which substantially limits the possibilities to influence the conditions in the system, so that the object, that is, uniform temperature conditions, cannot be achieved. It is a further drawback that the system is very complex and expensive and the energy consumption for the cooling system is high.

SUMMARY OF THE INVENTION

It is an object of the invention to provide an improved arrangement of the above-outlined type from which the discussed disadvantages are eliminated and which, in particular, when heat expansion occurs, ensures in a simple manner an unchanging or substantially unchanging working distance (such as a carding gap) between the cylinder clothing and the clothed and/or non-clothed counter element.

This object and others to become apparent as the specification progresses, are accomplished by the invention, according to which, briefly stated, the carding machine includes a main carding cylinder including a cylindrical jacket having an outer surface; a cylinder clothing carried on the outer jacket surface; and radial supporting elements supporting the cylindrical jacket. The carding machine further has a machine element defining a radial clearance with the cylinder clothing; two stationary lateral shield plates flanking the main carding cylinder; and an arrangement for reducing heat removal from the lateral shield plates to adapt a heat-caused expansion of the lateral shield plates to a heat-caused expansion of the main carding cylinder.

By reducing the extent of the outward-directed heat removal of the lateral shield plates, it is ensured in a particularly simple manner that the working distance (carding gap) remains at least substantially unchanged when heat-caused expansion of the components takes place. Despite the unlike possibilities for heat removal from the carding cylinder, on the one hand and the lateral shield plates, on the other hand, the working distance between the cylinder clothing and the cooperating clothed or non-clothed counter element remains the same. It is a particular advantage of the invention that the working components cooperating with the carding cylinder may remain structurally unchanged since they are carried by the lateral shield plates. In this manner a compensation between the unlike expansion behavior of the lateral shield plates and the main carding cylinder is achieved particularly because of the different extent of heat removal from the encapsulated main carding cylinder and the lateral shield plates which are in contact with the ambient air. By virtue of the measures according to the invention, the heat expansion of the lateral shield plates remains the same.

The invention has the following additional advantageous features:

- The temperature difference between the structural elements is compensated for by a lesser extent of heat removal from the lateral shield plates.
- The temperature difference between the structural elements is compensated for by a lesser heat-caused expansion of the main carding cylinder.
- The lateral shield plates are provided with a heat insulation on their side oriented away from the main carding cylinder; such heat insulation may be an insulating coating, a layer, a baffle plate or the like, made from an expandable polystyrene sold under the trademark STYROPOR.
- The expansion behavior of the radial carrier elements is adapted to that of the lateral shield plates.
- The expansion behavior of the cylindrical jacket of the main carding cylinder is adapted to that of the lateral shield plates.
- The expansion behavior of the radial carrier elements is adapted to that of the cylindrical jacket of the carding cylinder.
- The external side of the lateral shield plates is provided with a cover.

DESCRIPTION OF THE PREFERRED EMBODIMENTS

Figure 1:
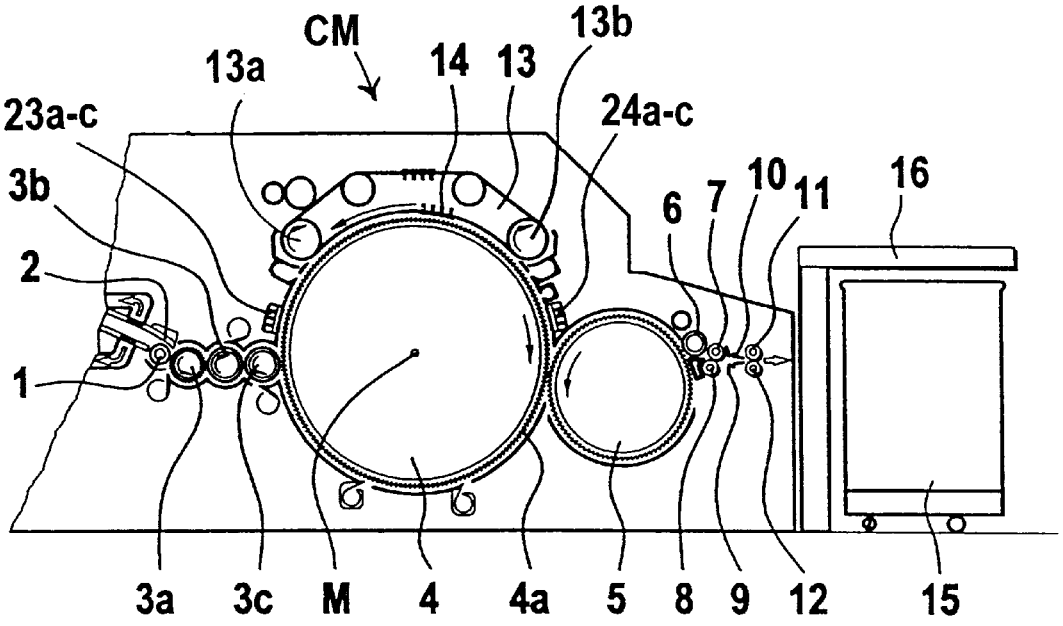
FIG. 1 is a schematic side elevational view of a carding machine adapted to incorporate the invention.

FIG. 1 shows a carding machine CM which may be, for example, an EXACTACARD DK 803 model, manufactured by Trützschler GmbH & Co. KG, Mönchengladbach, Germany. The carding machine CM has a feed roll 1, a feed table 2 cooperating therewith, licker-ins 3*a,* 3*b,* 3*c,* a main carding cylinder 4 having a rotary axis M, a doffer 5, a stripping roll 6, crushing rolls 7 and 8, a web guiding element 9, a sliver trumpet 10, calender rolls 11, 12, a traveling flats assembly 13 including flat bars 14, a coiler can 15 and a sliver coiling mechanism 16. Between the licker-in 3*c* and the end sprocket 13*a* of the traveling flats assembly 13 stationary carding elements 23*a–c* are disposed, whereas between the doffer 5 and the end sprocket 13*b* stationary carding elements 24*a–c* are provided. Further, curved cylinder cover elements (cover shells) are provided which conform to the curvature of the cylindrical surface of the carding cylinder 4.

Figure 2A:
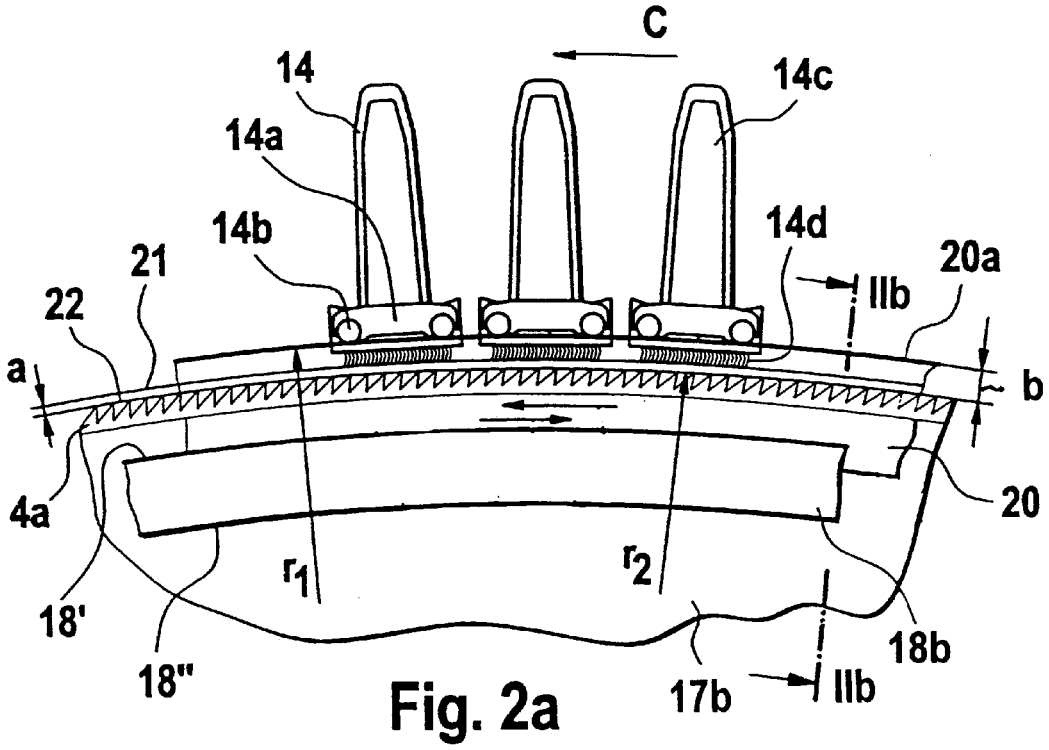
FIG. 2*a* is a fragmentary schematic side elevational view of a traveling flats assembly showing three flat bars, a sliding guide with a lateral shield plate and a clearance between the flat bar clothings and the carding cylinder clothing.
Figure 2B:
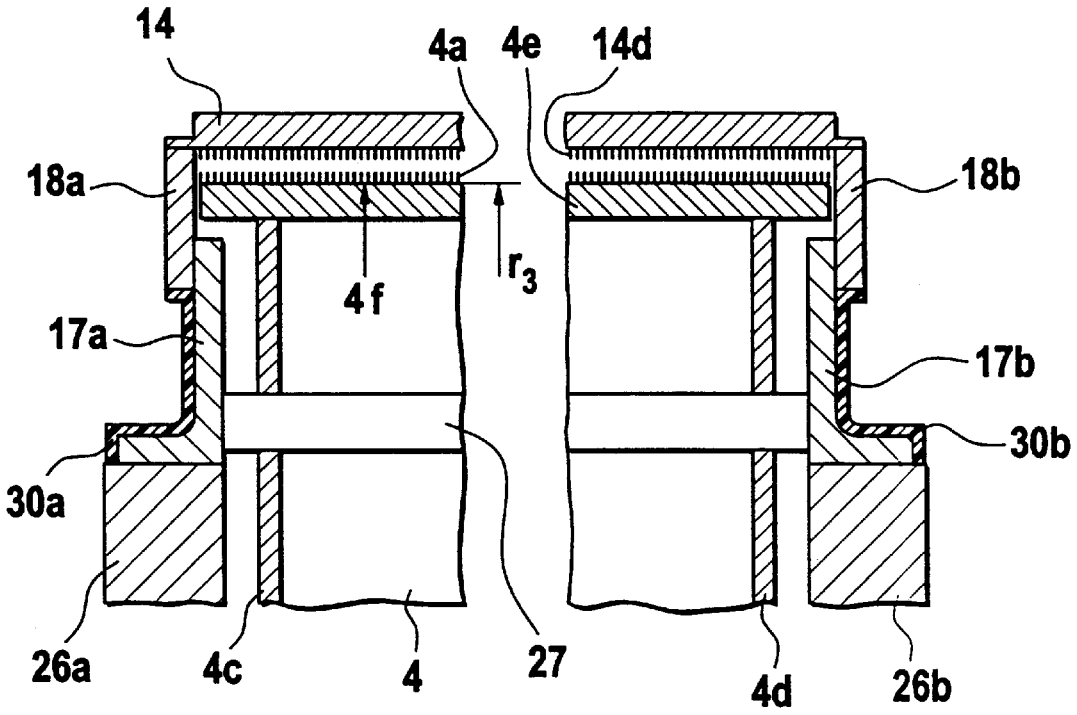
FIG. 2*b* is a sectional view taken along line IIb—IIb of FIG. 2*a*.

Turning to FIGS. 2*a* and 2*b,* approximately semicircular, rigid lateral shield plates 17*a* and 17*b* are secured to machine frame components 26*a* and 26*b* on either side of the carding cylinder 4. Arcuate supporting elements (flexible bends) 18*a* and 18*b* are mounted by screws 19 on and along the outer peripheral region of the respective lateral shield plates 17*a,* 17*b.* Each flexible bend 18*a,* 18*b* has an outer convex supporting surface 18' and an underside 18". Above the flexible bends 18*a,* 18*b* respective sliding guides 20 are provided which may be made, for example, of a low-friction synthetic material. The flat bars 14 each have a carrier body 14*c* and a head 14*a* supporting two pairs of steel pins 14*b* which extend parallel to the machine width, that is, parallel to the cylinder axis M. The flat bar pins 14*b* glide on the convex outer surface 20*a* of the sliding guide 20 in the direction of the arrow C. A flat bar clothing 14*d* is mounted on the underface of the carrier body 14*c.* A circle circumscribable on the points of the flat bar clothings 14*d* is designated at 21. The carding cylinder 4 has on its circumference a cylinder clothing 4*a,* such as a sawtooth clothing. A circle circumscribable on the points of the cylinder clothing 4*a* is designated at 22. The distance a between the circles 21 and 22 is approximately 0.20 mm. The distance between the convex outer surface 20*a* and the circle 22 is designated at b. The radius of the convex outer surface 20*a* is $r_1$ and the radius of the circle 22 is $r_2$. The starting points of the radii $r_1$ and $r_2$ lie on the rotary axis M of the carding cylinder 4. The stationary carding elements 23*a–c* and 24*a–c* are on each side secured by screws 28 to a respective extension arc 29 (see FIG. 3) which is affixed to the lateral shield plates 17*a* and 17*b* on each side of the carding machine.

FIG. 2*b* illustrates one part of the carding cylinder 4 which is composed of a cylindrical shell 4*e* having an outer surface 4*f* and cylinder bases 4*c* and 4*d* (radial carrier elements). The surface 4*f* is provided with the sawtooth clothing 4*a* which is mounted on the shell 4*e* in close, side-by-side arranged windings between non-illustrated side flanges to form a cylindrical working surface provided with clothing points. The fibers are intended to be treated on the working surface of the carding cylinder 4 as uniformly as possible along its entire width (axial length). The carding work is performed by cooperating, facing clothings. Such a carding work is to a large measure affected by the position of the cooperating clothings relative to one another as well as the clothing distance a between the points of the cooperating clothings. The working width of the carding cylinder is determinative for all the other working elements of the carding machine, particularly for the traveling flats 14 or the stationary carding elements 23 *a–c,* 24*a–c* which, together with the carding cylinder 4, card the fibers uniformly over the entire working width of the carding machine.

Figure 2C:
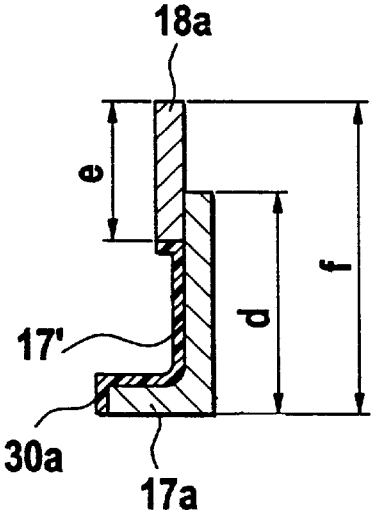
FIG. 2*c* is a detail of FIG. 2*b* showing distance relationships.

To ensure a uniform carding over the entire working width, the settings of the working elements (including additional elements) have to be maintained throughout the working width. The carding cylinder 4, however, may undergo deformation as a result of mounting the clothing wire thereon, or because of centrifugal forces or heat-up during the carding process. The shaft 27 of the carding cylinder 4 is supported in bearings which are mounted in the stationary machine frame 26*a,* 26*b.* The diameter of the cylinder surface 4*f,* for example, 1250 mm (twice the radius $r_3$) which is an important machine parameter, increases during operation because of heat effects. Referring to FIG. 2*c,* the lateral shield plates 17*a,* 17*b* are secured on both sides of the machine frame 26*a* and 26*b* respectively and have a radially measured width dimension d. The flexible bends 18*a* and 18*b* secured to the respective lateral shield plates 17*a,* 17*b* have, as shown in FIG. 2*c,* a radially measured width dimension e.

Figure 2D:
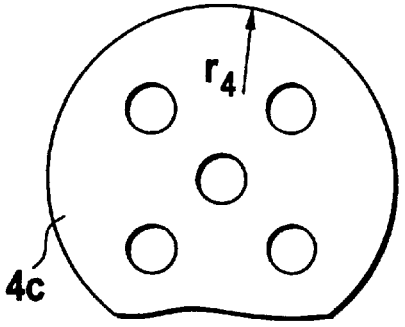
FIG. 2*d* is a fragmentary side elevational view of a carding cylinder base plate illustrated on a reduced scale.
Figure 3:
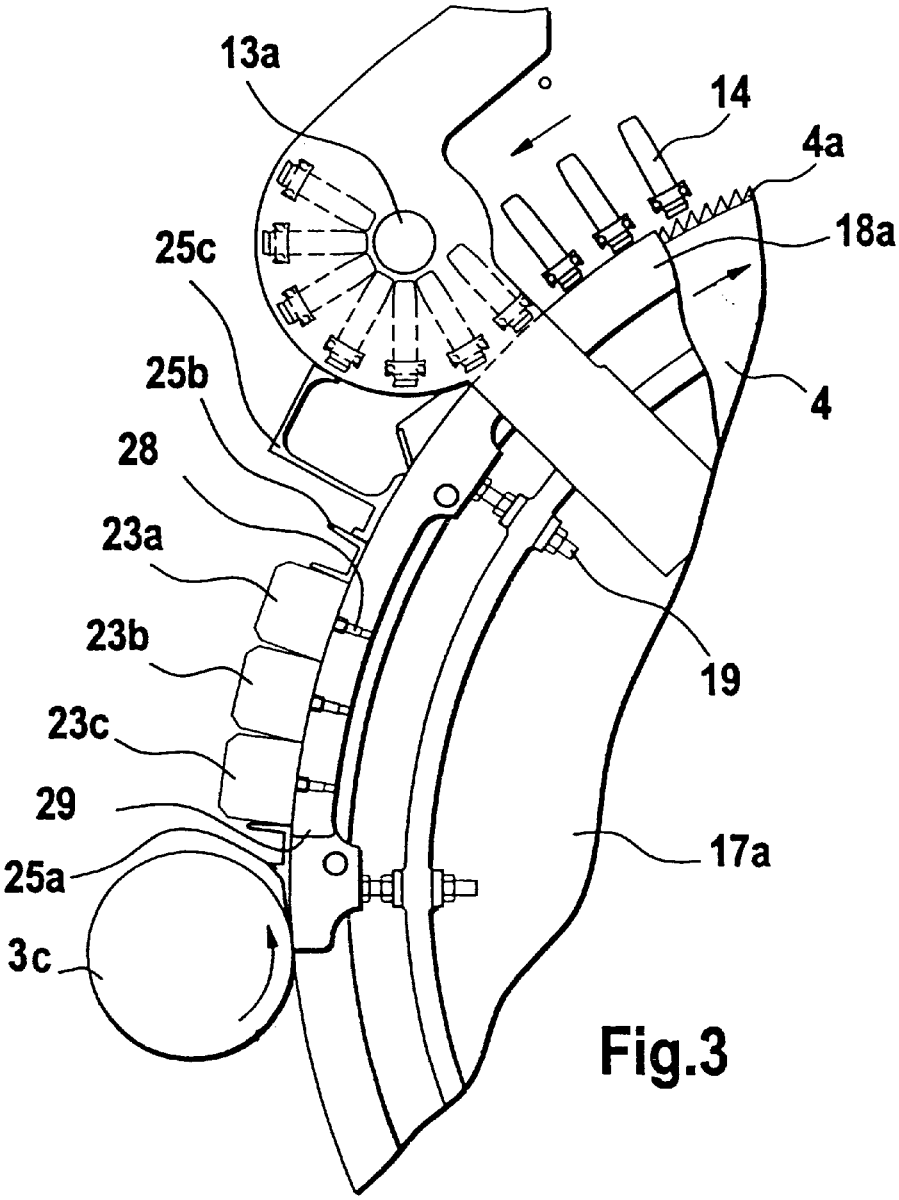
FIG. 3 is a fragmentary side elevational view of a lateral shield plate, a flexible bend, a carding cylinder, stationary carding elements, cylinder cover elements and flat bars.

If during operation the carding work, because of a high output and/or processing of chemical fibers, for example, cotton/chemical fiber mixtures, generates heat in the carding gap a between the clothings 14*d* (or in the carding gap c between the clothings 23') and the cylinder clothing 4*a,* the cylinder jacket 4*e* expands, that is, the radius $r_3$ increases and the carding gap a or, as the case may be, c, decreases. The heat is conducted into the radial carrier elements and the cylinder bases 4*c,* 4*d* via the cylinder jacket 4*e.* As a result, the cylinder bases 4*c,* 4*d* also expand, that is, the radius $r_4$ (see FIG. 2*d*) increases. The carding cylinder 4 is on all sides practically entirely closely surrounded by structural elements. Thus, as seen in FIG. 1, the carding cylinder is surrounded along the lower circumferential half by housing shells and along the upper circumferential half by carding elements 14, 23*a–c,* 24*a–c* as well as housing elements 25*a–c.* Further, at the two sides of the carding machine the carding cylinder 4 is bounded by elements 17*a,* 17*b,* 18*a,* 18*b,* 26*a* and 26*b.* As a result, the heat is radiated into the atmosphere from the carding cylinder 4 only to an insignificant extent. Particularly the heat of the large-surface cylinder bases 4*c* and 4*d* is transferred by radiation to a substantial extent to the large-surface lateral shield plates 17*a,* 17*b* from which the heat is radiated outwardly into the colder atmosphere. By virtue of such a radiation the lateral shield plates 17*a* and 17*b* expand to a relatively small extent as compared to the cylinder bases 4*c* and 4*d* which leads to an undesired carding result or even to a dangerous decrease of the carding gap a (FIG. 2*a*) and the carding gap c (FIG. 3). The traveling carding elements (flat bars 14) are supported on flexible bends 18*a,* 18*b,* whereas the stationary carding elements 23, 24 are supported on extension bends 29 which, in turn, are secured to the lateral shield plates 17*a,* 17*b.* With reference to FIG. 2*c,* upon heating, the distance d and thus, via the distance e, the entire section f expands to a relatively lesser extent than the radius $r_4$ of the cylinder bases 4*c,* 4*d* and the radius $r_3$ of the cylinder jacket 4*e.* The cylinder jacket 4*e* and the cylinder bases 4*c* and 4*d* are of steel, such as St37 having a longitudinal heat expansion coefficient of $11.5\times10^{-6}$[l/°K]. The lateral shield plates 17*a,* 17*b* are, for example, of gray cast iron having a similar coefficient of heat expansion of $10.5\times 10^{-6}$[l/°K].

Because of the substantially encapsulated nature of the main carding cylinder 4, the outward heat radiation therefrom is impeded and consequently, the carding cylinder 4 expands to a greater extent than the lateral shield plates 17*a,* 17*b* from which heat may radiate freely into the ambient atmosphere. To compensate for such different rates of heat-caused expansion of the cylinder bases 4*c,* 4*d* and the cylinder jacket 4*e* on the one hand, and the lateral shield plates 17*a,* 17*b* on the other hand, the lateral shield plates 17*a,* 17*b* are, at their outer surfaces 17' which are exposed to the ambient atmosphere, at least partially provided with a heat insulating coating, layer or panel 30*a* and 30*b,* such as an expandable polystyrene sold under the trademark STYROPOR, which reduces the outwardly directed heat radiation. As a result, while the cylinder 4 expands due to the reduced heat removal because of the encapsulation, the expansion of the lateral shield plates (distance d in FIG. 2*c*) remains the same by virtue of the heat insulation. The heat irradiated from the cylinder bases 4*c* and 4*d* remains in the lateral shield plates 17*a* and 17*b,* respectively. As a result, the undesired reduction of the carding gap a or c caused by thermal effects is avoided.

Figure 3A:
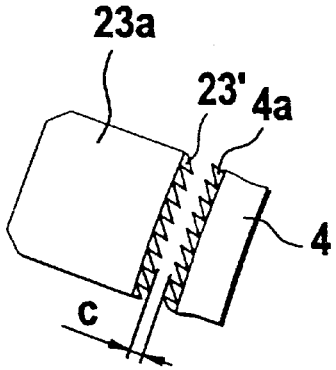
FIG. 3*a* illustrates a stationary carding element and further shows a fragment of the carding cylinder to illustrate the clearance between the two clothings thereof.

Turning to FIG. 3, three stationary carding elements 23*a,* 23*b* and 23*c* as well as cylinder covering shell elements 25*a,* 25*b* and 25*c* are provided between the licker-ins 3*a,* 3*b* and 3*c* and the traveling flats sprocket 13*a.* The stationary carding elements 23*a,* 23*b* and 23*c,* as shown in FIG. 3*a* for the stationary carding element 23*a,* have a clothing 23' which faces the cylinder clothing 4*a.* The carding gap between the clothing 23' and the cylinder clothing 4*a* is designated at c. The stationary carding elements 23*a–c* are mounted by means of screws 28 and the cover elements 25*a–c* are mounted by non-illustrated screws on an extension bend 29 which is secured on each side of the carding machine to the respective lateral shield plate 17*a* and 17*b.* FIG. 3 shows the extension bend 29 only on one side of the carding machine and also, only the lateral shield plate 17*a* is visible in that Figure.

It will be understood that the above description of the present invention is susceptible to various modifications, changes and adaptations, and the same are intended to be comprehended within the meaning and range of equivalents of the appended claims.

What is claimed is:

1. A carding machine comprising (a) a main carding cylinder including a cylindrical jacket having an outer surface; a cylinder clothing carried on said outer surface; and radial supporting elements supporting said cylindrical jacket;

(b) a machine element defining a radial clearance with said cylinder clothing;

(c) two stationary lateral shield plates flanking said main carding cylinder; and (d) means for adapting a heat-caused expansion of said lateral shield plates to a heat-caused expansion of said main carding cylinder.

2. The carding machine as defined in claim 1, wherein said means includes means for reducing heat removal from said lateral shield plates.

3. The carding machine as defined in claim 2, wherein said lateral shield plates have surfaces oriented away from said main carding cylinder; further wherein said means for reducing heat removal comprises a heat insulation provided on said surfaces of said lateral shield plates.

4. The carding machine as defined in claim 3, wherein said heat insulation comprises a heat insulating coating.

5. The carding machine as defined in claim 3, wherein said heat insulation comprises a heat insulating panel.

6. The carding machine as defined in claim 5, wherein said insulating panel is an expandable polystyrene panel.

* * * * *